US007887647B2

(12) United States Patent
Maeda et al.

(10) Patent No.: US 7,887,647 B2
(45) Date of Patent: Feb. 15, 2011

(54) SOFT MAGNETIC MATERIAL AND DUST CORE PRODUCED THEREFROM

(75) Inventors: Toru Maeda, Itami (JP); Yasushi Mochida, Itami (JP); Takao Nishioka, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 438 days.

(21) Appl. No.: 12/092,000

(22) PCT Filed: Sep. 8, 2006

(86) PCT No.: PCT/JP2006/317854

§ 371 (c)(1),
(2), (4) Date: Apr. 29, 2008

(87) PCT Pub. No.: WO2007/052411

PCT Pub. Date: May 10, 2007

(65) Prior Publication Data

US 2009/0121175 A1 May 14, 2009

(30) Foreign Application Priority Data

Nov. 2, 2005 (JP) ..... 2005-319974

(51) Int. Cl.
*H01F 1/20* (2006.01)

(52) U.S. Cl. ..... 148/306; 252/62.54; 428/403

(58) Field of Classification Search ..... None
See application file for complete search history.

(56) References Cited

U.S. PATENT DOCUMENTS

2003/0047245 A1* 3/2003 Takemoto et al. ..... 148/306
2007/0290161 A1* 12/2007 Tokuoka et al. ..... 252/62.54
2008/0061264 A1* 3/2008 Maeda et al. ..... 252/62.51 R

FOREIGN PATENT DOCUMENTS

| | | |
|---|---|---|
| JP | 2-163302 A | 6/1990 |
| JP | 4356527 | 12/1992 |
| JP | 7-245209 A | 9/1995 |
| JP | 2000-003824 | 1/2000 |
| JP | 2003-272911 | 9/2003 |
| JP | 2005-248273 A | 9/2005 |
| JP | 2005-248274 A | 9/2005 |

(Continued)

OTHER PUBLICATIONS

Abstract from esp@cenet database of JP2000-003824, published on Jan. 7, 2000, 1 page.

(Continued)

*Primary Examiner*—John P Sheehan
(74) *Attorney, Agent, or Firm*—Osha Liang LLP

(57) ABSTRACT

A soft magnetic material includes a plurality of composite magnetic particles each including a metal magnetic particle and an insulating coating film covering the metal magnetic particle. Each of the plurality of composite magnetic particles has a ratio $R_{m/c}$ of a maximum diameter to a circle-equivalent diameter of more than 1.15 and not more than 1.35. The insulating coating film is composed of a thermosetting organic material and has a pencil hardness of 5H or higher after thermosetting. With this material, an eddy current loss can be reduced, and a compact with a high strength can be formed.

6 Claims, 9 Drawing Sheets

FOREIGN PATENT DOCUMENTS

| | | | |
|---|---|---|---|
| JP | 2006-005173 | A | 1/2006 |
| JP | 2006-024869 | A | 1/2006 |
| JP | 2006-302958 | A | 11/2006 |
| WO | 2005/083725 | A1 | 9/2005 |

OTHER PUBLICATIONS

Abstract from esp@cenet database of JP4-356527, published on Dec. 10, 1992, 1 page.
Abstract from esp@cenet database of JP2005-248273, published on Sep. 15, 2005, 1 page.
Abstract from esp@cenet database of JP2005-248274, published on Sep. 15, 2005, 1 page.
Patent Abstracts of Japan, Publication No. 2006-302958, dated Nov. 2, 2006, 1 page.
Abstract from esp@cenet database of JP2006-024869, published on Jan. 26, 2006, 1 page.
Abstract from esp@cenet database of JP2006-005173, published on Jan. 5, 2006, 1 page.
Patent Abstracts of Japan, Publication No. 2003-272911, dated Sep. 26, 2003, 1 page.
International Search Report issued in PCT/JP2006/317854, mailed on Nov. 14, 2006, 2 pages.

* cited by examiner

SOFT MAGNETIC MATERIAL AND DUST CORE PRODUCED THEREFROM

TECHNICAL FIELD

The present invention relates to soft magnetic materials and dust cores produced by using the soft magnetic materials. In particular, it relates to a soft magnetic material containing composite magnetic particles constituted by metal magnetic particles and insulating coating films on the metal magnetic particles, and a dust core produced by using such a soft magnetic material.

BACKGROUND ART

In electrical apparatuses having solenoid valves, motors, power supply circuits, or the like, dust cores produced by pressure-forming soft magnetic materials are used. A soft magnetic material is composed of a plurality of composite magnetic particles, and each composite magnetic particle is constituted by a metal magnetic particle and a vitreous insulating organic coating film covering the surface of the metal magnetic particle. The magnetic properties required for the soft magnetic material are to achieve a high magnetic flux density by application of a small magnetic field, and high sensitivity to changes in external magnetic fields.

In the case where a soft magnetic material is used under an AC magnetic field, an energy loss called "core loss" occurs. The core loss is a sum of a hysteresis loss and an eddy-current loss. A hysteresis loss is an energy loss caused by the energy needed to change the magnetic flux density of the soft magnetic material. The hysteresis loss is proportional to the operating frequency and is thus dominant mainly in a low frequency range. An eddy-current loss is an energy loss mainly caused by the eddy current flowing between the metal magnetic particles. The eddy current loss is proportional to the square of the operating frequency and is thus dominant mainly in a high frequency region. In recent years, electrical devices are required to achieve size reduction, higher efficiency, and higher output. In order to fulfill such requirements, the electrical devices must be used in a high frequency region. Due to this, it is particularly desirable to decrease the eddy current loss of the dust core.

In order to decrease the hysteresis loss in the core loss of the soft magnetic material, the distortions and dislocations inside the metal magnetic particles should be removed to promote movements of domain walls and to thereby decrease the coercive force Hc of the soft magnetic material. In contrast, in order to decrease the eddy-current loss in the core loss of the soft magnetic material, each of the metal magnetic particles should be completely covered with an insulating organic coating film to ensure insulation between the metal magnetic particles and to thereby increase the electrical resistivity ρ of the soft magnetic material.

A technique related to the soft magnetic material is disclosed in Japanese Unexamined Patent Application Publication No. 2003-272911 (Patent Document 1). Patent Document 1 discloses an iron-based powder (soft magnetic material) in which aluminum phosphate-based insulating organic coatings having high heat resistance are formed on surfaces of particles mainly composed of iron. According to Patent Document 1, a dust core is produced by the following process. First, an aqueous solution of an insulating coating film containing an aluminum-containing phosphate and a dichromate containing, e.g., potassium is sprayed onto iron particles. Then the iron particles sprayed with the aqueous solution of the insulating coating film were retained at 300° C. for 30 minutes and at 100° C. for 60 minutes. As a result, the insulating organic coatings on the iron particles dry, and an iron, based powder is obtained. Subsequently, the iron-based powder is pressure-formed and then heat-treated to produce a dust core.

Patent Document 1: Japanese Unexamined Patent Application Publication No. 2003-272911

DISCLOSURE OF INVENTION

Problems to be Solved by the Invention

As described above, since a dust core is produced by pressure-forming a soft magnetic material, high formability is required for a soft magnetic material. However, during pressure-forming of the soft magnetic material, the insulating organic coatings easily break due to the pressure. As a result, electrical shorting easily occurs between the particles of iron powder, thereby leading to problems such as an increased eddy current loss and accelerated deterioration of the insulating organic coating films during heat treatment for removing distortions after the forming, also resulting in an increased eddy current loss. In contrast, in the case where the pressure during pressure-forming is decreased to prevent the insulating organic coating films from breaking, the density of the resulting dust core decreases, and sufficient magnetic properties cannot be obtained. Therefore, it has not been possible to decrease the pressure during pressure-forming. Another technique for suppressing the breaking of the insulating organic coating films during the pressure-forming is to use spherical particles produced by gas atomization. However, this technique is not suitable for increasing the density of the compact, and the resulting compact has a low strength.

In view of the above, an object of the present invention is to provide a soft magnetic material that can decrease the eddy current loss and that can produce a compact having a high strength. A dust core produced by using the soft magnetic material is also provided.

Means for Solving the Problems

A soft magnetic material of the present invention includes a plurality of composite magnetic particles each including a metal magnetic particle and an insulating coating film covering the metal magnetic particle. Each of the plurality of composite magnetic particles has a ratio $R_{m/c}$ of the maximum diameter to a circle-equivalent diameter of more than 1.15 and not more than 1.35. The insulating coating film is composed of an organic material and has a pencil hardness of 5H or higher after thermosetting.

The present inventors have found that cause of the breaking of the insulating coating film during the pressure-forming of the soft magnetic material is the presence of the projected portions (portions with small radii of curvature) on the metal magnetic particles. In other words, during pressure-forming, stresses concentrate on the projected portions of the metal magnetic particles, and the projected portions undergo significant deformation. At this time, the insulating coating film that cannot deform significantly along with the metal magnetic particle may break or the projected portions may stave the insulating coating film. Accordingly, in order to prevent breaking of the insulating coating films during pressure-forming, it is effective to reduce the projected portions of the metal magnetic particles.

As the metal magnetic particles, there are a starting material powder produced by a water-atomization technique (hereinafter simply referred to as "water-atomized powder") and a starting material powder produced by a gas-atomization technique (hereinafter simply referred to as "gas-atomized powder"). Since the particles of the water-atomized powder have many projected portions, the insulating coating films easily break during the pressure-forming. In contrast, the starting material powder produced by gas-atomization (hereinafter referred to as "gas-atomized powder") are nearly spherical and have few projected portions. One conceivable approach for preventing the breaking of the insulating coating film during pressure-forming is to use gas-atomized powder as the metal magnetic particles instead of the water-atomized powder. However, since metal magnetic particles are attached with one another by engagement of surface irregularities, the metal magnetic particles made from nearly spherical gas-atomized powder do not easily attached to one another, thereby significantly lowering the strength of the compact. As a result, metal magnetic particles made of gas-atomized powder cannot be used to make practical dust cores. In other words, reduction of eddy current loss and improving the strength of the compact cannot be achieved by directly using the water-atomized powder or the gas-atomized powder.

The present inventors have found that reduction of eddy current loss and improving the strength of the compact can be both achieved by using a soft magnetic material in which each of the composite magnetic particles has a ratio $R_{m/c}$ of the maximum diameter to the circle-equivalent diameter of more than 1.15 and not more than 1.35 and in which the insulating coating film is composed of a thermosetting organic material and exhibits a pencil hardness of 5H or higher after thermosetting. The composite magnetic particles of the soft magnetic material of the present invention have smaller projected portions compared to the particles of typical water-atomized powders. Thus, stress concentration does not easily occur, and the insulating coating films do not easily break. Moreover, since the insulating coating film before thermosetting has capacity to follow the deformation, the insulating coating film does not easily break during pressure-forming of the soft magnetic material. Thus, a highly dense compact can be obtained, and the eddy current loss can be decreased. The pencil hardness of the insulating coating film can be increased to 5H or higher by thermosetting the resulting compact by a suitable heat treatment. Since the modified insulating coating film has a high hardness, a compact having a high strength can be obtained.

Preferably, in the soft magnetic material of the present invention, the average thickness of the insulating coating film in an uncured state is 10 nm or more and 500 nm or less.

When the average thickness of the insulating coating film is 10 nm or more, the insulating coating film does not easily break despite occurrence of stress concentration, and the resistance to compressive stresses during forming is improved. Moreover, generation of tunneling current can be prevented, and energy loss caused by eddy current can be effectively suppressed. On the other hand, by adjusting the thickness of the insulating coating film to be 500 nm or less, the insulating coating film does not easily detach from the metal magnetic particle, and resistance to shear stresses during forming is improved. Moreover, the proportion of the soft magnetic material occupied by the insulating coating film is prevented from becoming excessively large. Accordingly, a large decrease in magnetic flux density of the dust core obtained by pressure-forming the soft magnetic material can be prevented.

In the soft magnetic material of the present invention, the average particle diameter $d_{AVE}$ of each of the composite magnetic particles is preferably 10 μm or more and 500 μm or less.

When the average particle diameter $d_{AVE}$ of each of the composite magnetic particles is 10 μm or more, the metal is nor easily oxidized, and degradation of magnetic properties of the soft magnetic material can be suppressed. When the average particle diameter of each of the composite magnetic particles is 500 μm or less, a decrease in compressibility of the mixed powder during pressure-forming can be suppressed. In this manner, the ease of handling can be maintained without decreasing the density of the compact formed by pressure-forming. From the magnetic property standpoint, adjusting the average particle diameter to 10 μm or more will suppress an increase in core loss caused by a demagnetizing effect that occurs when bridges are formed during powder-charging and cavities are formed due to such bridges. Moreover, adjusting the average particle diameter to 500 μm or less will suppress an increase in eddy current loss caused by generation of eddy current loss inside the particle.

In the soft magnetic material of the present invention, each of the composite magnetic particles preferably further includes a coupling coating film between the metal magnetic particle and the insulating coating film.

According to this structure, the adhesion between the metal magnetic particle and the insulating coating film can be improved, and the breaking of the insulating coating film during forming can be suppressed. A material having high adhesion to both the metal magnetic particle and the insulating coating film is used in the coupling coating film.

A dust core of the present invention is produced by using the soft magnetic material described above. In this manner, a dust core having a low eddy current loss and a high strength can be obtained.

In the dust core of the present invention, when an average particle diameter of each of the plurality of composite magnetic particles is represented by $d_{AVE}$ (μm) and an electrical resistance of the metal magnetic particle is represented by ρ (μΩcm), the eddy current loss at an exciting magnetic flux density of 1 (T) and an exciting magnetic flux frequency of 1 (kHz) is preferably $0.02\times(d_{AVE})^2/\rho$ (W/kg) or less, and the three-point bending strength $\sigma_{3b}$ at room temperature is preferably $800\times(R_{m/c})^{0.75}/(d_{AVE})^{0.5}$ (MPa) or more.

ADVANTAGES

According to the soft magnetic material of the present invention and the dust core produced by using the soft magnetic material, the eddy current loss can be reduced, and a compact having a high strength can be obtained.

REFERENCE NUMERALS

Figure 1:
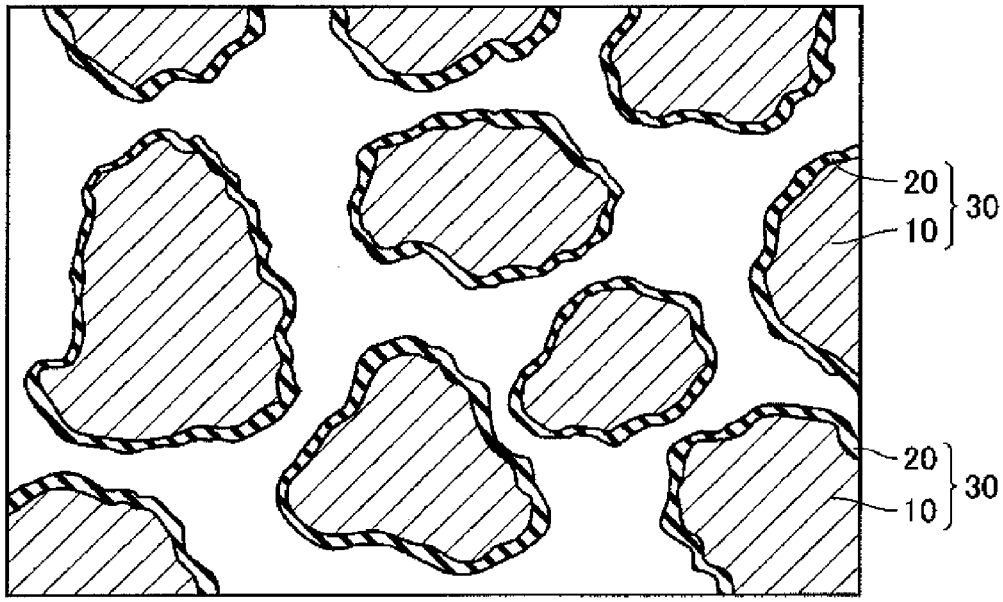
FIG. 1 is a schematic diagram showing a soft magnetic material according to an embodiment of the present invention.

10: metal magnetic particle
20: insulating coating film
21: coupling coating film
22: protective coating film
30, 130*a*, 130*b*: composite magnetic particle
31: irregularities
131: projected portions

BEST MODES FOR CARRYING OUT THE INVENTION

An embodiment of the present invention will now be described with reference to the drawings.

FIG. 1 is a schematic view of a soft magnetic material according to an embodiment of the present invention. Referring to FIG. 1, the soft magnetic material of this embodiment includes a plurality of composite magnetic particles 30, each including a metal magnetic particle 10 and an insulating coating film 20 covering the surface of the metal magnetic particle 10.

Figure 2:
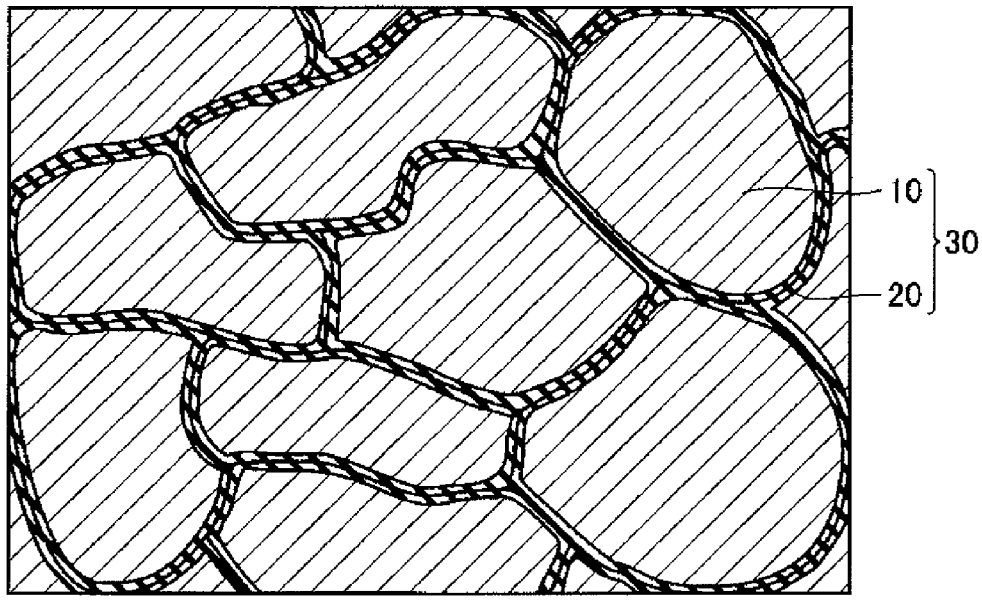
FIG. 2 is an enlarged cross-sectional view of a dust core according to an embodiment of the present invention.

FIG. 2 is an enlarged cross-sectional view of a dust core according to an embodiment of the present invention. Note that the dust core shown in FIG. 2 is produced by pressure-forming and heating the soft magnetic material shown in FIG. 1. Referring now to FIGS. 1 and 2, in the dust core of this embodiment, the composite magnetic particles 30 are connected to one another with organic materials (not shown) that exist between the composite magnetic particles 30 or through engagement between irregularities on the surfaces of the composite magnetic particles 30, for example.

Figure 3:
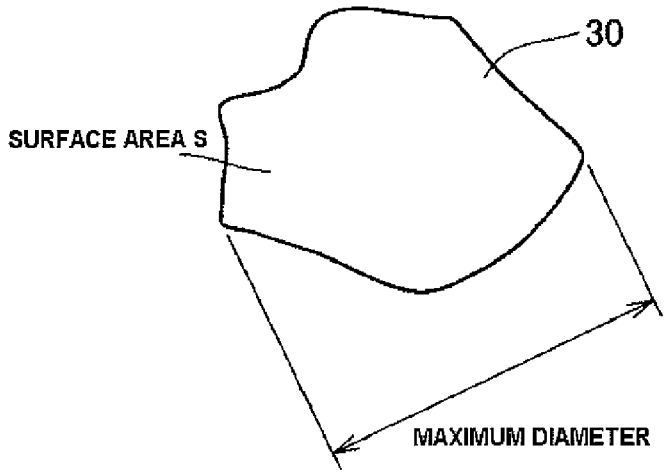
FIG. 3 is a schematic plan view of one composite magnetic particles constituting a soft magnetic material according to an embodiment of the present invention.

FIG. 3 is a schematic plan view of one composite magnetic particle constituting the soft magnetic material according to an embodiment of the present invention. Referring to FIG. 3, in the composite magnetic particle 30 of the soft magnetic material of the present invention, the ratio $R_{m/c}$ of the maximum diameter to the circle-equivalent diameter is more than 1.15 and not more than 1.35. The maximum diameter and the circle-equivalent diameter of the composite magnetic particle 30 are determined as follows.

The maximum diameter of the composite magnetic particle 30 is determined by identifying the shape of the composite magnetic particle 30 by an optical technique (e.g., observation with an optical microscope) and measuring the length of the portion where the maximum particle diameter can be taken. The circle-equivalent diameter of the composite magnetic particle 30 is determined by identifying the shape of the composite magnetic particle 30 by an optical technique (e.g., observation with an optical microscope), measuring the surface area S of the composite magnetic particle 30 in a plan view, and calculating the circle-equivalent diameter using equation (1) below:

$$\text{Circle-equivalent diameter}=2\times\{\text{Surface area } S/\pi\}^{1/2} \quad (1)$$

Figure 4:
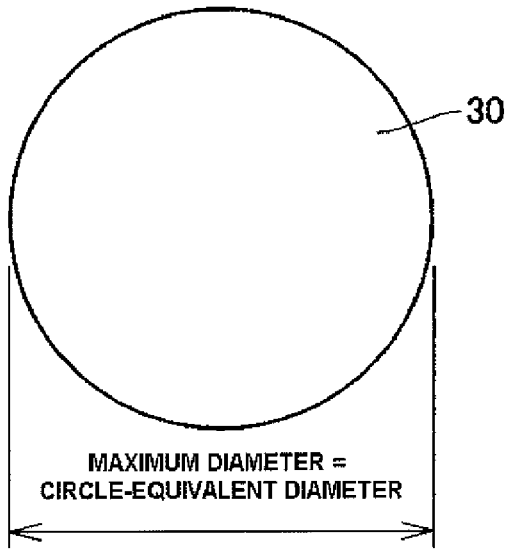
FIG. 4 is schematic plan view of a composite magnetic particle spherical in shape.
Figure 5:
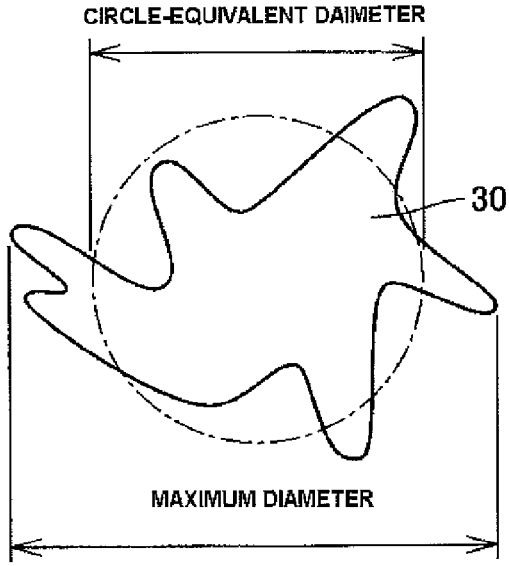
FIG. 5 is a schematic plan view of a composite magnetic particle with large projected portions.

That is, the ratio of the maximum diameter to the circle-equivalent diameter is 1 when the composite magnetic particle is spherical as shown in FIG. 4. The ratio increases when the composite magnetic particle has large projected portions as shown in FIG. 5.

Referring to FIGS. 1 to 3, the average particle diameter $d_{AVE}$ of the composite magnetic particle 30 is preferably 10 μm or more and 500 μm or less. When the average particle diameter $d_{AVE}$ of the composite magnetic particle 30 is 10 μm or more, the metal is not readily oxidized, and degradation of magnetic properties of the soft magnetic material can be suppressed. When the average particle diameter $d_{AVE}$ of the composite magnetic particle 30 is 500 μm or less, the decrease in compressibility of the mixed powder during pressure-forming can be suppressed. As a result, difficulty of handling can be eliminated without decreasing the density of the compact formed by pressure-forming.

Note that "average particle diameter" refers to a 50% particle diameter D, i.e., the diameter of a particle, the cumulative sum of masses of particles up to which reaches 50% of the total mass of the particles in a histogram of particle diameters measured by a sieve method.

The metal magnetic particle 10 is composed of, for example, Fe, an Fe—Si-based alloy, an Fe—Al-based alloy, an Fe—N-based alloy, an Fe—Ni-based alloy (permalloy), an Fe—C-based alloy, an Fe—B-based alloy, an Fe—Co-based alloy, an Fe—P-based alloy, an Fe—Ni—Co-based alloy, an Fe—Cr-based alloy, or an Fe—Al—Si-based alloy (sendust). The metal magnetic particle 10 may be composed of an elemental metal or an alloy as long as the iron is contained as the main component.

The insulating coating film 20 serves as an insulating layer between the metal magnetic particles 10. Covering the metal magnetic particle 10 with the insulating coating film 20 increases the electrical resistivity ρ of the dust core obtained by pressure-forming the soft magnetic material. As a result, the eddy current is suppressed from flowing between the metal magnetic particles 10, and, in the eddy-current loss of the dust core, the eddy-current loss caused by the eddy current flowing between the particles can be decreased. The insulating coating film 20 is composed of a thermosetting organic material and has a pencil hardness of 5H or higher after thermosetting. In particular, a material, such as a low-molecular-weight silicone resin or an acrylic resin, that changes from a state having a low hardness to a state having a significantly high hardness by thermosetting treatment is preferred. More preferably, an organic-inorganic hybrid material that has adequate resin characteristics and undergoes adequate curing after the change is used.

The hardness of the insulating coating film after thermosetting is graded by a scratch test by a pencil method described in Japanese Industrial Standards (JIS) K 5600-5-4 (pencil hardness). A sample formed by applying a material of an insulating coating film on a glass substrate and thermosetting the applied material under predetermined conditions is used as the evaluation sample.

The pencil hardness is measured by the following process. First, a sample is placed on a flat horizontal surface so that a surface coated with the material of the insulating coating film faces up. Next, several types of pencils with different hardnesses are prepared. Wood is carefully removed from each pencil so that the cylindrical lead smooth and free of damages is exposed. Five to six millimeters of lead is exposed, and the tip of the lead is flattened so that the corners at the tip of the lead are sharp. Next, the pencil is loaded in a pencil scratch tester so that the pencil is inclined at 45° with respect to the coating surface and pressed against the upper surface of the sample under a load of 750±10 g. The pencil is then slid on the upper surface of the sample. The sliding rate is 0.5 to 1.0 mm per second and the sliding distance is 7 mm or more. Whether or not the coating surface of the material of the insulating coating film ruptures is observed. The test is repeated by increasing the hardness of the pencil until scratches of 3 mm or more are obtained. In the case where the scratch is obtained, the test is repeated by decreasing the hardness of the pencil until no scratches are obtained. As a result, the hardness number of the hardest pencils among the pencils that created no scratches is assumed to be the pencil hardness of that insulating coating film. The test is conducted twice, and if the results of the two tests differ by 1 unit or more, the results are abandoned and the test is repeated.

The average thickness of the insulating coating film 20 is preferably 10 nm or more and 500 nm or less in an uncured state. When the average thickness of the insulating coating film 20 is 10 nm or more, the insulating coating film 20 does not easily break despite stress concentration, and the resistance to the compressive stress during forming can be improved. Occurrence of tunneling current can be prevented, and the energy loss caused by the eddy current can be effectively suppressed. On the other hand, the average thickness of the insulating coating film 20 is set to 500 nm or less so that the insulating coating film 20 does not easily separate from the metal magnetic particle 10 and the resistance to shear stresses during forming can be improved. Moreover, at such a thickness, the proportion of the soft magnetic material occupied by the insulating coating film 20 is not excessively large. Accordingly, the magnetic flux density of the dust core produced by pressure-forming the soft magnetic material can be prevented from decreasing excessively.

The average thickness of the insulating coating film can be measured by observation under a transmission electron microscope (TEM), for example. Alternatively, mass spectrometry of constituent elements of the insulating coating film may be conducted by ICP analysis, and the average thickness may be determined by conversion from the surface area of the coated powder and the density of the insulating coating film.

Although the layer coating the metal magnetic particle is a single layer in the above description, the layer coating the metal magnetic particle may be constituted by a plurality of layers as described below.

Figure 6:
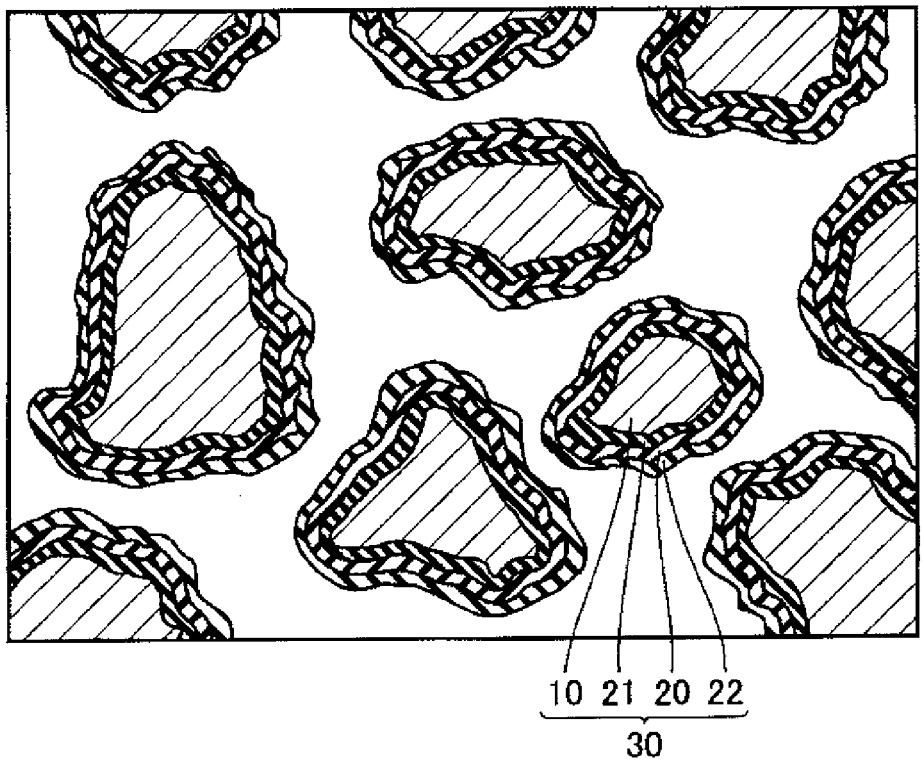
FIG. 6 is a schematic view of another soft magnetic material according to an embodiment of the present invention.

FIG. 6 is a schematic view of another soft magnetic material according to an embodiment of the present invention. Referring to FIG. 6, each of the composite magnetic particles 30 of another soft magnetic material of this embodiment further includes a coupling coating film 21 and a protective coating film 22. The coupling coating film 21 is formed between the metal magnetic particle 10 and the insulating coating film 20 so as to cover the surface of the metal magnetic particle 10. The protective coating film 22 is formed to cover the surface of the insulating coating film 20. In other words, the coupling coating film 21, the insulating coating film 20, and the protective coating film 22 are stacked in this order so as to coat the surface of the metal magnetic particle 10.

A material exhibiting good adhesion to both the metal magnetic particle and the insulating coating film is used as the coupling coating film 21. A material that does not inhibit compressive deformation and that does not exhibit conductivity is preferred. To be more specific, glassy insulating amorphous films such as metal phosphate and metal borate are suitable. An organic coupling agent having a hydrophilic group, such as a silane coupling agent, may be used. A material, such as wax, that can improve slidability is used as the protective coating film 22.

Figure 7:
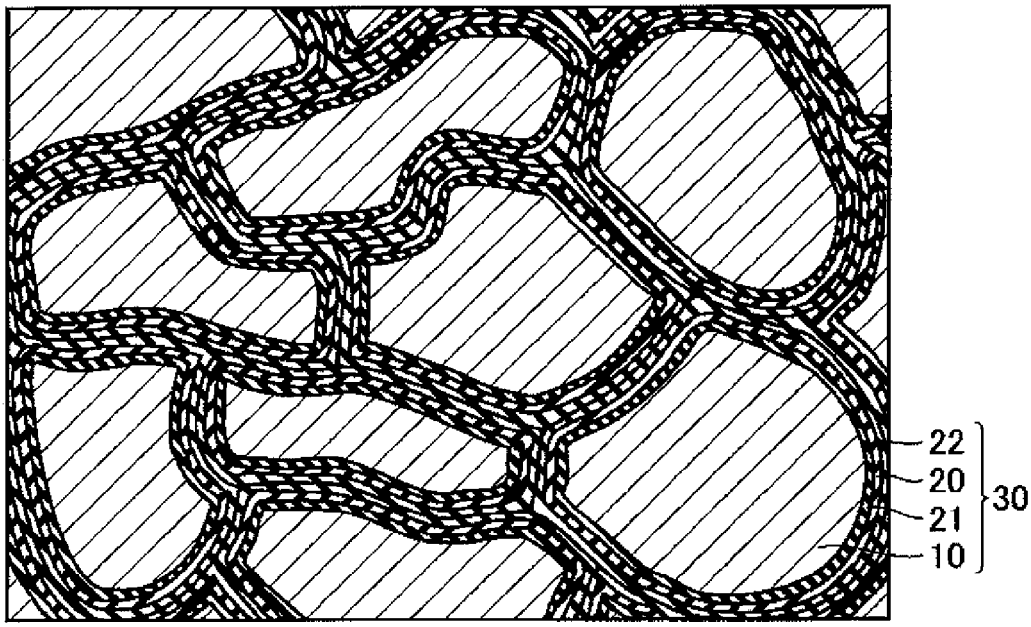
FIG. 7 is an enlarged cross-sectional view of another dust core according to an embodiment of the present invention.

FIG. 7 is an enlarged cross-sectional view of another dust core according to an embodiment of the present invention. The dust core shown in FIG. 7 is produced by subjecting the soft magnetic material shown in FIG. 6 to pressure-forming, thermosetting treatment, and heat treatment for removing distortions. Referring now to FIGS. 6 and 7, when a resin is used as the insulating coating film 20, the resin undergoes chemical changes such as pyrolysis, evaporation, or the like, during heating. Moreover, when a wax is used as the protective coating film 22, the wax is sometimes removed by the heat during heating.

Figure 8:
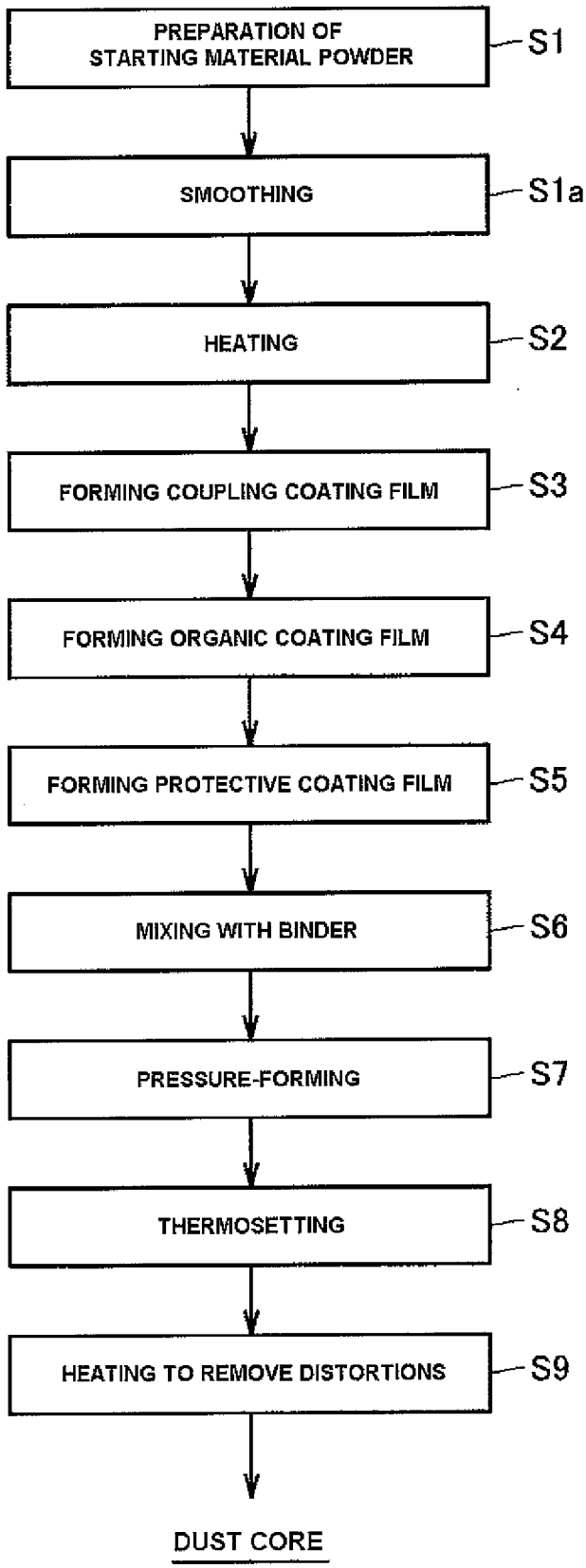
FIG. 8 is a flowchart showing a sequence of steps of a process for making a dust core according to an embodiment of the present invention.

The method for producing the soft magnetic material and the dust core of this embodiment will now be described. FIG. 8 is a flowchart showing a sequence of steps of the method for producing the dust core according to an embodiment of the present invention.

Referring to FIG. 8, first, a starting material powder of the metal magnetic particle 10 is prepared (S1). The starting material powder contains Fe as the main component and is composed of, for example, pure iron having a purity or 99.8% or more, Fe, an Fe—Si-based alloy, or an Fe—Co-based alloy. During this step, the average particle diameter of the metal magnetic particle 10 prepared is controlled to 10 μm or more and 500 μm or less so that the average particle diameter of the each of the composite magnetic particles 30 in the resulting soft magnetic material is 10 μm or more and 500 μm or less. This is because the total thickness of the coupling coating film 21, the insulating coating film 20, and the protective coating film 22 is negligibly small compared to the particle diameter of the metal magnetic particle 10 and thus the particle diameter of the composite magnetic particle 30 is substantially the same as the particle diameter of the metal magnetic particle 10.

In the case where the metal magnetic particle 10 is a water-atomized particle, the surface of the metal magnetic particle 10 have many projected portions. Thus, in order to remove these projected portions, the surface layer of the metal magnetic particle 10 is smoothed (step S1*a*). In particular, the surface of the soft magnetic material is allowed to wear in a ball mill to remove the projected portions on the surface of the metal magnetic particle 10. More projected portions will be removed by extending the processing time in the ball mill. Thus, the metal magnetic particle 10 becomes close to spherical. By setting the ball mill processing time to 30 to 60 minutes, for example, a metal magnetic particle 10 in which the ratio of the maximum diameter to the circle-equivalent diameter is more than 1.15 and not more than 1.35 is obtained.

Next, the metal magnetic particle 10 is heated at a temperature of 400° C. or more but less than the melting temperature (step S2). The interior of the metal magnetic particle 10 before heating has many distortions (dislocations and defects). Such distortions can be reduced by heating the metal magnetic particle 10. The heating temperature is more preferably 700° C. or more and less than 900° C. Heating in this temperature range can sufficiently remove distortions, and sintering of the particles can be avoided. Note that this heating process may be omitted.

Next, the coupling coating film 21 for improving the adhesion between the metal magnetic particle 10 and the insulating coating film 20 is formed if necessary (step S3). The coupling coating film 21 is required not to inhibit compressive deformation and not to exhibit conductivity. For example, a glassy insulating amorphous film such as a metal phosphate, a metal borate, or the like, is suitable. As the method for forming a phosphate insulating coating film, phosphate conversion treatment, solvent spraying, or a sol-gel treatment using a precursor may be employed. Moreover, an organic coupling agent having a hydrophilic group, such as a silane coupling agent, may be used. The coupling coating film need not be formed.

Next, the insulating coating film 20 is formed using a material composed of a thermosetting organic material and exhibiting a pencil hardness of 5H or higher after thermosetting (step S4). As the insulating coating film 20, for example, silsesquioxane, which is a silicon-based organic-inorganic hybrid material, is used. The insulating coating film 20 is formed by mixing the metal magnetic particle 10 with silsesquioxane or its derivative dissolved in an organic solvent or by spraying silsesquioxane or its derivative dissolved in an organic solvent, followed by drying to remove the solvent.

Next, the protective coating film 22 composed of, for example, a wax is formed on the surface of the insulating coating film 20 (step S5). Note that it is not essential to form the protective coating.

The soft magnetic material of this embodiment is obtained through the above-described steps. In order to produce a dust core of the present invention, the following steps are further conducted.

The composite magnetic particle 30 is mixed with an organic material serving as a binder (step S6). The mixing method is not particularly limited. For example, a dry mixing method using a V-type mixing apparatus or a wet mixing method using a mixer-type mixing apparatus may be employed. As a result, the composite magnetic particles 30 are bonded to one another with the organic material. This step of mixing with a binder may be omitted.

Examples of the organic material include thermoplastic resins such as thermoplastic polyimide, thermoplastic polyamide, thermoplastic polyamideimide, polyphenylene sulfide, polyamideimide, polyethersulfone, polyetherimide, and polyetheretherketone; non-thermoplastic resins such as high-molecular-weight polyethylene, wholly aromatic polyester, and wholly aromatic polyimide; and higher fatty acids such as zinc stearate, lithium stearate, calcium stearate, lithium palmitate, calcium palmitate, lithium oleate, and calcium oleate. A mixture of these may also be used.

The resulting powder of the soft magnetic material is placed in a die and pressure-formed at a pressure ranging from 390 (MPa) to 1500 (MPa) (step S7). As a result, a compact of the metal magnetic particles 10 can be obtained. The atmosphere for the pressure-forming is preferably an inert gas atmosphere or a vacuum atmosphere. In this manner, oxidation of the mixed powder by oxygen in air can be suppressed.

The compact obtained by pressure-forming is thermally cured at a temperature in the range of the thermosetting temperature of the insulating coating film 20 to the pyrolytic temperature of the insulating coating film 20 (step S8). As a result, the insulating coating film 20 is thermally cured, and the strength of the compact increases.

In the above description, thermosetting of the insulating coating film 20 is conducted after pressure-forming of the soft magnetic material. Alternatively, a die having a temperature set to the thermosetting temperature of the insulating coating film 20 or more and the pyrolytic temperature of the insulating coating film 20 or less may be used during the pressure-forming. In such a case, since the insulating coating film can be heated with the die, the pressure-forming and the thermosetting can be conducted simultaneously.

The compact is then heated at a temperature lower than the temperature at which the insulating coating film 20 loses the insulating property (step S9). Since many distortions and dislocations exist in the interior of the compact after the pressure-forming, such distortions and dislocations can be removed by heat treatment. Note that this heat treatment for removing distortions can be omitted. The dust core of this embodiment is thus produced through the above-described steps.

The soft magnetic material and the dust core of this embodiment can increase the strength of the compact while reducing the eddy-current loss. This feature is addressed below.

Figure 9:
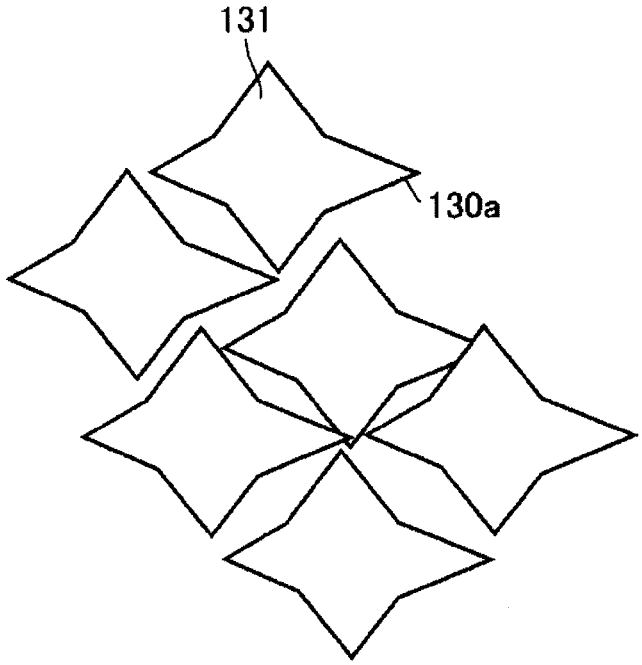
FIG. 9 PRIOR ART
FIG. 9 is a schematic diagram showing the state of engagement between composite magnetic particles made of a water-atomized powder.

FIG. 9 is a schematic diagram showing how the composite magnetic particles made from a water-atomized powder are connected to one another. Referring now to FIG. 9, a composite magnetic particle 130*a* made from a water-atomized powder has many projected portions 131. Accordingly, the composite magnetic particles 130*a* engage with one another using these projected portions. Thus, the bonds between the composite magnetic particles 130*a* can be strengthened, and the strength of the compact can be increased. On the other hand, since stress concentration occurs at the projected portions of the composite magnetic particles 130*a* during pressure-forming, the insulating organic coatings will be broken. As a result, the eddy-current loss is increased.

Figure 10:
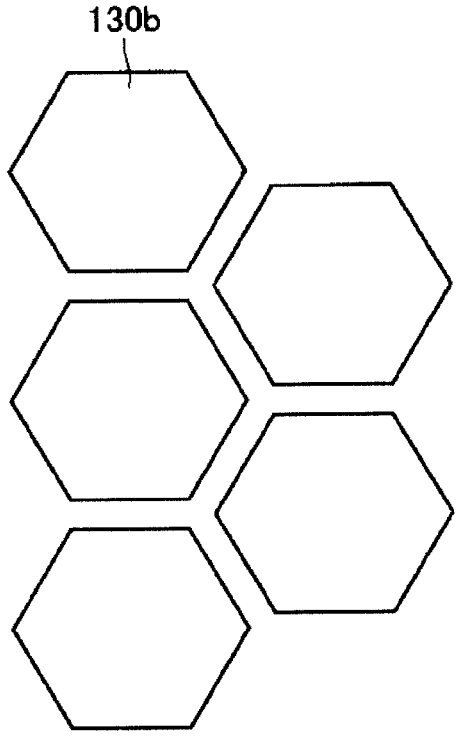
FIG. 10 PRIOR ART
FIG. 10 is a schematic diagram showing the state of engagement between composite magnetic particles made of a gas-atomized powder.

FIG. 10 is a schematic diagram showing how composite magnetic particles made from a gas-atomized powder are connected to one another. Referring to FIG. 10, a composite magnetic particle 130*b* made from a gas-atomized powder scarcely has any projection. Thus, the insulating organic coatings on the composite magnetic particles 130*b* are prevented from breaking during the pressure-forming, and the eddy-current loss can be reduced. In contrast, since the composite magnetic particle 130*a* has no projected portions, the connection between the composite magnetic particles 130*b* is weak, and the strength of the compact is low.

Figure 11:
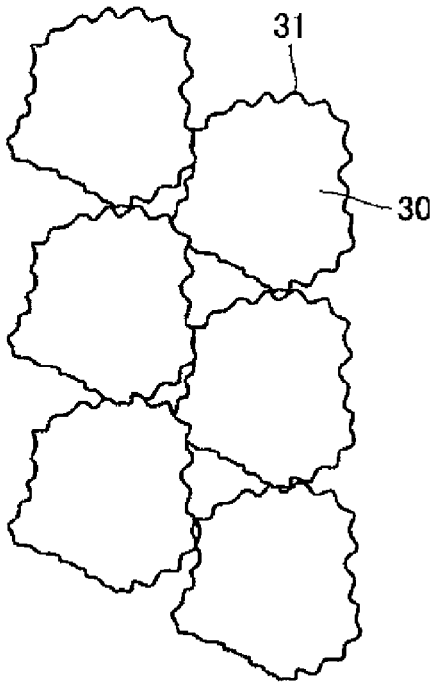
FIG. 11 is a schematic diagram showing the state of engagement between composite magnetic particles of the present invention.

As shown in FIGS. 9 and 10, the existing composite magnetic particles obtained from the water-atomized powder and the gas-atomized powder cannot increase the strength of the compact while reducing the eddy-current loss. In contrast, as shown in FIG. 11, the composite magnetic particles 30 of the soft magnetic material of this invention have irregularities 31 smaller than the projected portions 131 of the composite magnetic particles 130*a* obtained from the water-atomized powder. Thus, breaking of the insulating coating films 20 can be suppressed during the pressure-forming, and the eddy-current loss can be reduced. Since the insulating coating film 20 before thermosetting has high deformation-following property, the eddy-current loss can be further reduced. Moreover, since the insulating coating film 20 exhibits a high pencil hardness of 5H or higher after thermosetting, the necking bonding between the metal magnetic particles 10 is not greatly weakened irrespective of the interposition of the insulating coating films 20. Thus, the compact can achieve a high strength.

In the dust core of this embodiment, the eddy-current loss $We_{10/1k}$ at an exciting magnetic flux density of 1 (T) and an exciting magnetic flux frequency of 1 (kHz) is $0.02\times(d_{AVE})^2/\rho$ (W/kg) or less, and the three-point bending strength $\sigma_{3b}$ at room temperature is $800\times(R_{m/c})^{0.75}/(d_{AVE})^{0.5}$ (MPa) or more, where the average particle diameter of each of the composite magnetic particles 30 is $d_{AVE}$ (μm) and the electrical resistivity of the metal magnetic particle 10 is ρ (μΩcm). In these two equations, the relationship that the eddy-current loss is proportional to the product of the reciprocal of electrical resistivity and the square of the particle diameter and the relationship that the strength is inversely proportional to the ½ power of the particle diameter (Hall-Petch relation) are in accordance with the theoretical relationships. The proportionality coefficients and the multiplier on $R_{m/c}$ are experimentally determined from the examples described below.

Example 1

In this example, the ball mill processing time for the metal magnetic particles was varied to prepare soft magnetic materials, and the ratio (maximum diameter/circle-equivalent diameter) $R_{m/c}$ of the maximum diameter of the composite magnetic particles of the soft magnetic material was studied.

First, as metal magnetic particles P1 to P13, water-atomized pure iron powders having a purity of 99.8% or more and a particle diameter of 50 to 150 μm were prepared. The average particle diameter $d_{AVE}$ was 90 μm, and the electrical resistivity ρ was 11 μΩcm. Subsequently, the metal magnetic particles of the water-atomized powders were spheroidized in a ball mill. For ball mill processing, Planetary ball mill P-5 produced by Fritsch was used. The ball mill processing time was varied in the range of 1 minute to 120 minutes to prepare a plurality of types of metal magnetic particles with different ball mill processing times. For comparative purposes, metal magnetic particles not subjected to ball mill processing were also prepared.

Metal magnetic particle samples P1 to P13 were each injected into an aqueous phosphoric acid solution having pH adjusted to 2.0, and the resulting mixture was stirred to form a coupling coating film, i.e., a ferric phosphate coating film, on the surface of the metal magnetic particle. Subsequently, an insulating coating film composed of a silicone resin (XC96-B0446 produced by GE Toshiba Silicones) was formed on the surface of the metal magnetic particle coated with the coupling coating film. The coating of the insulating coating film was done by injecting the metal magnetic particle into a xylene solution of a material of the insulting coating film, stirring the resulting mixture, and volatilizing xylene. The insulating coating film was formed while adjusting the average film thickness to be 200 nm. Soft magnetic material samples P'1 to P'13 were obtained as such.

For soft magnetic material samples P'1 to P'13 obtained as above, the ratio $R_{m/c}$ of the maximum diameter of the composite magnetic particle to the circle-equivalent diameter of the composite magnetic particle (maximum diameter/circle-equivalent diameter) was determined. The results are shown in Table I and FIG. 12.

TABLE I

| Sample No. | Ball mill processing time (min) | Maximum dia./circular equivalent dia. $R_{m/c}$ | Note |
|---|---|---|---|
| P'1 | 0 | 1.54 | Comparative |
| P'2 | 5 | 1.55 | Examples |
| P'3 | 7 | 1.53 | |
| P'4 | 10 | 1.46 | |
| P'5 | 15 | 1.42 | |
| P'6 | 20 | 1.38 | |
| P'7 | 25 | 1.35 | Examples |
| P'8 | 30 | 1.3 | |
| P'9 | 40 | 1.24 | |
| P'10 | 60 | 1.19 | |
| P'11 | 80 | 1.15 | |
| P'12 | 100 | 1.11 | Comparative |
| P'13 | 120 | 1.09 | Examples |

Figure 12:
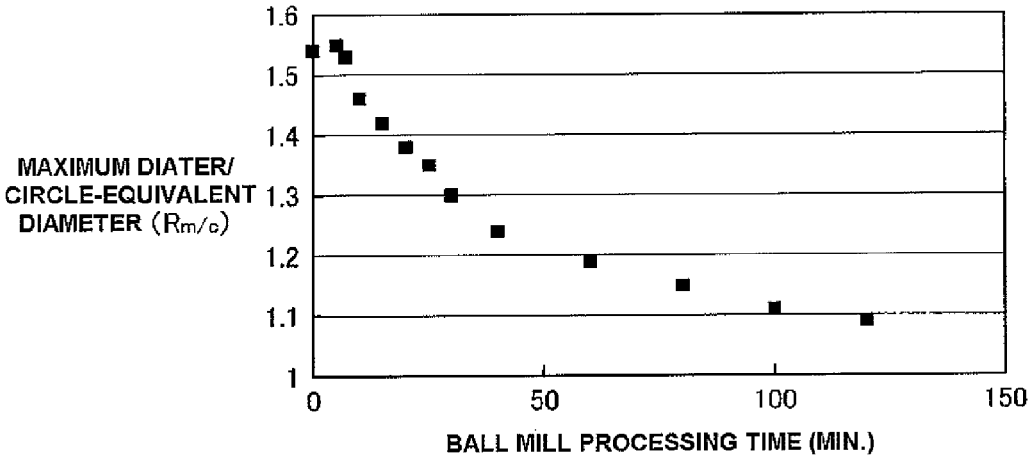
FIG. 12 is a graph showing the relationship between the ball mill processing time and the ratio ($R_{m/c}$) of the maximum diameter of the metal magnetic particle to the circle-equivalent diameter in Example 1 of the present invention.

Referring now to Table I and FIG. 12, comparison between samples P'1 to P'13 shows that as the ball mill processing time becomes longer, the ratio $R_{m/c}$ of the maximum diameter to the circle-equivalent diameter of the composite magnetic particle becomes close to 1. In particular, the ratio $R_{m/c}$ in samples P'7 to P'11 exceeds 1.15 and not 1.35, which is in the range of the present invention. This shows that as the ball mill processing time is prolonged, more projected portions are removed and the composite magnetic particle becomes more spherical. Moreover, the ratio $R_{m/c}$ remained the same even when the material constituting the insulating coating film is changed.

Example 2

In this example, the soft magnetic materials obtained in Example 1 were used to form dust cores. In particular, metal magnetic particle samples P1 to P13 obtained in Example 1 were used to form dust core samples A1 to A13, B1 to B13, C1 to C13, and D1 to D13 according to the methods described below. Samples A1 to A13, B1 to B13, C1 to C13, and D1 to D13 are equivalent to samples P'1 to P'13.

Sample A1 to A13: Soft magnetic materials respectively containing metal magnetic particle samples P1 to P13 coated with insulating coating films composed of a silicone resin (XC96-B0446 produced by GE Toshiba Silicones) as in Example 1 were prepared. Each of the soft magnetic materials was pressure-formed at a bearing stress of 980 to 1280 MPa to form a ring-shaped compact (34 mm in outer diameter, 20 mm in inner diameter, 5 mm in thickness) having a density of 7.60 g/cm$^3$. A rectangular parallelepiped compact having a width of 10 mm, a length of 55 mm, and a thickness of 10 mm was also formed in the same manner. Each compact was heated in air at 200° C. for 1 hour to thermally cure the insulating coating film. Subsequently, the compact was heated in a nitrogen atmosphere in the temperature ranging from 300° C. to 700° C. for 1 hour to prepare a dust core. The observed pencil hardness of the insulating coating film after thermosetting was 2H.

Samples B1 to B13: Soft magnetic materials respectively containing magnetic particle samples P1 to P13 coated with silsesquioxane (OX-SQ/20SI produced by TOAGOSEI Co., Ltd.) in Example 1 were prepared. The rest of the process for making dust cores was the same as those for samples A1 to A13 in Example 1. The observed pencil hardness of the insulating coating film after thermosetting was 4H.

Samples C1 to C13: Soft magnetic materials respectively containing magnetic particle samples P1 to P13 coated with silsesquioxane (OX-SQ produced by TOAGOSEI Co., Ltd.) in Example 1 were prepared. The rest of the process for making dust cores was the same as those for samples A1 to A13 in Example 1. The observed pencil hardness of the insulating coating film after thermosetting was 5H.

Samples D1 to D13: Soft magnetic materials respectively containing magnetic particle samples P1 to P13 coated with silsesquioxane (AC-SQ produced by TOAGOSEI Co., Ltd.) in Example 1 were prepared. The rest of the process for making dust cores was the same as those for samples A1 to A13 in Example 1. The observed pencil hardness of the insulating coating film after thermosetting was 7H.

A magnetic property measurement sample was prepared by conducting winding on each of the dust cores obtained as above so that the number of turns for the primary was 300 and that for the secondary was 20. The core loss of each sample at 10 kG (equal to 1 tesla (T)) exciting magnetic flux density was measured while varying the frequency in the range of 50 Hz to 1 kHz using an AC BH curve tracer. Then the eddy current loss coefficient was calculated from the core loss. The eddy current loss coefficient was calculated by fitting the frequency curve of the core loss by a least-square method using three equations below, and the eddy current loss $We_{10/1k}$ was calculated from the eddy current loss coefficient:

$$\text{(Core loss)}=\text{(hysteresis loss coefficient)}\times\text{(frequency)}+\text{(eddy current loss coefficient)}\times\text{(frequency)}^2$$

$$\text{(Hysteresis loss)}=\text{(hysteresis loss coefficient)}\times\text{(frequency)}$$

$$\text{(Eddy current loss)}=\text{(eddy current loss coefficient}\times\text{(frequency)}^2$$

Moreover, each of dust core samples A1 to A13, B1 to B13, C1 to C13, and D1 to D13 was subjected to three-point bending strength test. This strength test was conducted at room temperature with a span of 40 mm. The eddy current loss $We_{10/1k}$ and the observed three-point bending strength $\sigma_{3b}$ of each of dust core samples A1 to A13, B1 to B13, C1 to C13, and D1 to D13 are shown in Tables II to V and FIGS. 13 and 14.

TABLE II

| | | Insulating coating film | | Dust core | | |
|---|---|---|---|---|---|---|
| Dust core sample No. | Metal magnetic particle sample No. | Name of coating material | Pencil hardness after thermosetting | Eddy current loss $We_{10/1k}$ (W/kg) | Three-point bending strength $\sigma_{3b}$ (MPa) | Note |
| A1 | P1 | XC96-B0446 | 2H | 21 | 53 | Comparative Examples |
| A2 | P2 | | | 20 | 50 | |
| A3 | P3 | | | 19 | 48 | |
| A4 | P4 | | | 19 | 44 | |
| A5 | P5 | | | 19 | 43 | |
| A6 | P6 | | | 17 | 42 | |
| A7 | P7 | | | 13 | 42 | |
| A8 | P8 | | | 12 | 41 | |
| A9 | P9 | | | 11 | 35 | |
| A10 | P10 | | | 10 | 33 | |
| A11 | P11 | | | 9 | 26 | |
| A12 | P12 | | | 9 | 22 | |
| A13 | P13 | | | 8 | 17 | |

TABLE III

| | | Insulating coating film | | Dust core | | |
|---|---|---|---|---|---|---|
| Dust core sample No. | Metal magnetic particle sample No. | Name of coating material | Pencil hardness after thermosetting | Eddy current loss $We_{10/1k}$ (W/kg) | Three-point bending strength $\sigma_{3b}$ (MPa) | Note |
| B1 | P1 | OX-SQ/20SI | 4H | 22 | 79 | Comparative Examples |
| B2 | P2 | | | 20 | 76 | |
| B3 | P3 | | | 19 | 73 | |
| B4 | P4 | | | 19 | 64 | |
| B5 | P5 | | | 20 | 65 | |
| B6 | P6 | | | 17 | 65 | |
| B7 | P7 | | | 12 | 63 | |
| B8 | P8 | | | 11 | 62 | |
| B9 | P9 | | | 10 | 55 | |
| B10 | P10 | | | 9 | 50 | |
| B11 | P11 | | | 11 | 38 | |
| B12 | P12 | | | 10 | 33 | |
| B13 | P13 | | | 10 | 25 | |

TABLE IV

| Dust core sample No. | Metal magnetic particle sample No. | Insulating coating film: Name of coating material | Insulating coating film: Pencil hardness after thermosetting | Dust core: Eddy current loss $We_{10/1k}$ (W/kg) | Dust core: Three-point bending strength $\sigma_{3b}$ (MPa) | Note |
|---|---|---|---|---|---|---|
| C1 | P1 | OX-SQ | 5H | 22 | 133 | Comparative |
| C2 | P2 | | | 20 | 130 | Examples |
| C3 | P3 | | | 19 | 129 | |
| C4 | P4 | | | 20 | 126 | |
| C5 | P5 | | | 20 | 125 | |
| C6 | P6 | | | 17 | 118 | |
| C7 | P7 | | | 11 | 110 | Examples |
| C8 | P8 | | | 10 | 105 | |
| C9 | P9 | | | 9 | 103 | |
| C10 | P10 | | | 9 | 96 | |
| C11 | P11 | | | 10 | 92 | |
| C12 | P12 | | | 9 | 62 | Comparative |
| C13 | P13 | | | 10 | 42 | Examples |

TABLE V

| Dust core sample No. | Metal magnetic particle sample No. | Insulating coating film: Name of coating material | Insulating coating film: Pencil hardness after thermosetting | Dust core: Eddy current loss $We_{10/1k}$ (W/kg) | Dust core: Three-point bending strength $\sigma_{3b}$ (MPa) | Note |
|---|---|---|---|---|---|---|
| D1 | P1 | AC-SQ | 7H | 23 | 166 | Comparative |
| D2 | P2 | | | 20 | 158 | Examples |
| D3 | P3 | | | 19 | 150 | |
| D4 | P4 | | | 19 | 138 | |
| D5 | P5 | | | 20 | 134 | |
| D6 | P6 | | | 18 | 131 | |
| D7 | P7 | | | 13 | 132 | Examples |
| D8 | P8 | | | 11 | 128 | |
| D9 | P9 | | | 11 | 122 | |
| D10 | P10 | | | 10 | 118 | |
| D11 | P11 | | | 10 | 109 | |
| D12 | P12 | | | 10 | 75 | Comparative |
| D13 | P13 | | | 10 | 54 | Examples |

Figure 13:
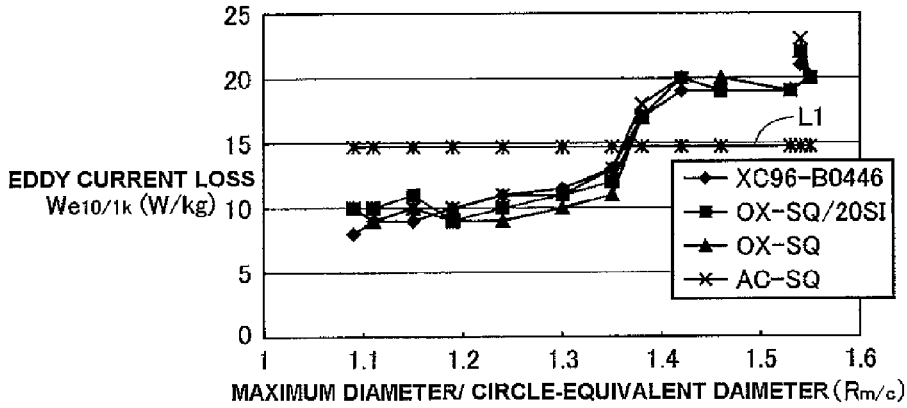
FIG. 13 is a graph showing the relationship between the ratio ($R_{m/c}$) of the maximum diameter of the metal magnetic particle to the circle-equivalent diameter and the eddy current loss We in Example 2 of the present invention.
Figure 14:
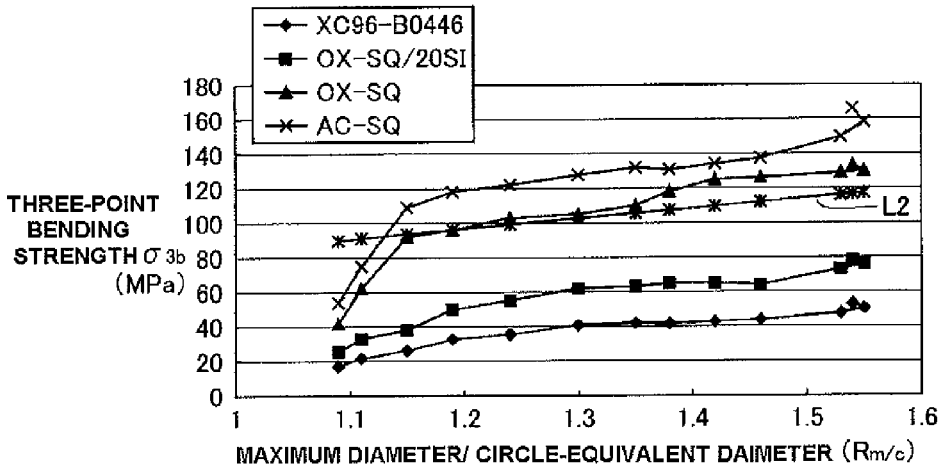
FIG. 14 is a graph showing the relationship between the relationship between the ratio ($R_{m/c}$) of the maximum diameter of the metal magnetic particle to the circle-equivalent diameter and the three-point bending strength.

Referring to Tables II to V and FIGS. 13 and 14, the three three-point bending strength $\sigma_{3b}$ of samples A1 to A13 is compared with that of samples B1 to B13 between the samples composed of the same metal magnetic particles. The same comparison was conducted for the three-point bending strength of samples C1 to C13 and D1 to D13. Samples C1 to C13 and D1 to D13 have significantly improved three-point bending strength $\sigma_{3b}$. In particular, when the three-point bending strength of samples B1 to B13 having a pencil hardness of 4H after thermosetting is compared with the three-point bending strength $\sigma_{3b}$ of samples C1 to C13 having a pencil hardness of 5H after thermosetting between the same metal magnetic particles, the three-point bending strength $\sigma_{3b}$ of samples C1 to C13 is about 1.5 times larger than the three-point bending strength of samples B1 to B13. These results show that the strength of the dust core can be improved by forming an insulating coating film having a pencil hardness of 5H or more after thermosetting.

When the three-point bending strength $\sigma_{3b}$ is compared between samples C1 to C13, samples C1 to C11 having a maximum diameter/circle-equivalent diameter ratio $R_{m/c}$ of 1.15 or more have a significantly improved three-point bending strength $\sigma_{3b}$. Similarly, in samples D1 to D13, samples D7 to D11 having a maximum diameter/circle-equivalent diameter ratio $R_{m/c}$ of 1.15 or more have a significantly improved three-point bending strength $\sigma_{3b}$. These results show that the strength of the dust core can be improved by setting the maximum diameter/circle-equivalent diameter ratio $R_{m/c}$ to 1.15 or more.

The eddy current loss $We_{10/1k}$ of samples C1 to C13 is then compared. Samples C7 to C11 having a maximum diameter/circle-equivalent diameter ratio $R_{m/c}$ of 1.35 or less exhibit a large decrease in eddy current loss $We_{10/1k}$. Similarly, among samples D1 to D13, samples D7 to D11 having a maximum diameter/circle-equivalent diameter ratio $R_{m/c}$ of 1.35 or less exhibit a large decrease in eddy current loss $We_{10/1k}$. These results show that the eddy current loss $We_{10/1k}$ can be decreased by setting the maximum diameter/circle-equivalent diameter ratio $R_{m/c}$ to 1.35 or less. On the basis of the results described above, it can be understood that a high-strength compact with a lower eddy current loss can be obtained by setting ratio $R_{m/c}$ of the maximum diameter to the circle-equivalent diameter of the composite magnetic particle to more than 1.15 and not more than 1.35 and by adjusting the pencil hardness of the insulating coating film after thermosetting to 5H or higher.

In FIG. 13, line L1 indicates a straight line satisfying $We_{10/1k}=0.02\times(d_{AVE})^2/\rho$ (W/kg). The eddy current loss $We_{10/1k}$ of samples C7 to C11 and D7 to D11 which are the examples of the present invention does not exceed $We_{10/1k}$ indicated by line L1. Moreover, in FIG. 14, line L2 indicates a straight line satisfying $\sigma_{3b}=800\times(R_{m/c})^{0.75}/(d_{AVE})^{0.5}$ (MPa). The three-point bending strength $\sigma_{3b}$ of samples C7 to C11 and D7 to D11, which are the examples of the present invention, is not lower than $\sigma_{3b}$ indicated by line L2.

Example 3

In this example, metal magnetic particle samples P14 to P17 composed of different materials and having different average particle diameters from those of samples in Examples 1 and 2 were prepared first.

Sample P14: A water-atomized pure iron powder having an average particle diameter $d_{AVE}$ of 50 μm and a purity of 99.8% or more was prepared as a metal magnetic particle. The electrical resistivity ρ was 11 μΩcm. The ball mill processing as in Example 1 was then performed so that the maximum diameter/circle-equivalent diameter ratio $R_{m/c}$ was about 1.20.

Sample P15: A water-atomized pure iron powder having an average particle diameter $d_{AVE}$ of 160 μm and a purity of 99.8% or more was prepared as a metal magnetic particle. The electrical resistivity ρ was 11 μΩcm. The ball mill processing as in Example 1 was then performed so that the maximum diameter/circle-equivalent diameter ratio $R_{m/c}$ was about 1.20.

Sample P16: A water-atomized pure iron powder having an average particle diameter $d_{AVE}$ of 90 μm and being composed of Fe-0.5% Si was prepared as a metal magnetic particle. The electrical resistivity ρ was 17 μΩcm. The ball mill processing as in Example 1 was then performed so that the maximum diameter/circle-equivalent diameter ratio $R_{m/c}$ was about 1.20.

Sample P17: A water-atomized pure iron powder having an average particle diameter $d_{AVE}$ of 90 μm and being composed of Fe-1.0% Si was prepared as a metal magnetic particle. The electrical resistivity ρ was 25 μΩcm. The ball mill processing as in Example 1 was then performed so that the maximum diameter/circle-equivalent diameter ratio $R_{m/c}$ was about 1.20.

Several types of insulating coating films having different pencil hardnesses after thermosetting were formed by using the metal magnetic particles obtained as above so as to prepare dust cores. Specific details are as follows.

Samples A14 to A17: An insulating coating film composed of a silicone resin (XC96-B0446 produced by GE Toshiba Silicones, pencil hardness: 2H) was formed on each of metal magnetic particle samples P14 to P17. The rest of the process for making dust cores was the same as those for samples A1 to A13 in Example 1.

Samples B14 to B17: An insulating coating film composed of silsesquioxane (OX-SQ/20SI produced by TOAGOSEI Co., Ltd., pencil hardness: 4H) was formed on each of metal particle samples P14 to P17. The rest of the process for making dust cores was the same as those for samples A1 to A13 in Example 1.

Samples C14 to C17: An insulating coating film composed of silsesquioxane (OX-SQ produced by TOAGOSEI Co., Ltd., pencil hardness: 5H) was formed on each of metal particle samples P14 to P17. The rest of the process for making dust cores was the same as those for samples A1 to A13 in Example 1.

Samples D14 to D17: An insulating coating film composed of silsesquioxane (AC-SQ produced by TOAGOSEI Co., Ltd., pencil hardness: 7H) was formed on each of metal particle samples P14 to P17. The rest of the process for making dust cores was the same as those for samples A1 to A13 in Example 1.

For each of the dust cores obtained as above, the eddy current loss $We_{10/1k}$ was calculated as in Example 1 and the three-point bending strength test was conducted. The eddy current loss $We_{10/1k}$ and the three-point bending strength $\sigma_{3b}$ of each of the dust cores of samples A14 to A17, B14 to B17, C14 to C17, and D14 to D17 are shown in Table VI. In Table VI, the results of Samples A9, B9, C9, and D9 in Examples 1 and 2 are also included.

TABLE VI

| | Soft magnetic material | | | Insulating coating film | | Dust core | | |
|---|---|---|---|---|---|---|---|---|
| Dust core sample No. | Metal magnetic particle sample No. | Processing time (min) | Maximum dia./circle-equivalent dia. Rm/c | Material of coating | Pencil hardness after thermal cure | Eddy current loss $We_{10/1k}$ (W/kg) | Three-point bending strength $\sigma_{3b}$ (MPa) | Note |
| A9 | P9 | 40 | 1.24 | XC96-B0446 | 2H | 12.0 | 35 | Comparative |
| B9 | | | | OX-SQ/20SI | 4H | 11.0 | 55 | Example |
| C9 | | | | OX-SQ | 5H | 10.0 | 86 | Example |
| D9 | | | | AC-SQ | 7H | 11.0 | 111 | |
| A14 | P14 | 50 | 1.20 | XC96-B0446 | 2H | 6.5 | 49 | Comparative |
| B14 | | | | OX-SQ/20SI | 4H | 6.4 | 75 | Example |
| C14 | | | | OX-SQ | 5H | 6.4 | 128 | Example |
| D14 | | | | AC-SQ | 7H | 6.3 | 142 | |
| A15 | P15 | 30 | 1.19 | XC96-B0446 | 2H | 20.5 | 20 | Comparative |
| B15 | | | | OX-SQ/20SI | 4H | 22.0 | 32 | Example |
| C15 | | | | OX-SQ | 5H | 19.6 | 74 | Example |
| D15 | | | | AC-SQ | 7H | 20.3 | 85 | |
| A16 | P16 | 60 | 1.20 | XC96-B0446 | 2H | 8.0 | 24 | Comparative |
| B16 | | | | OX-SQ/20SI | 4H | 8.0 | 48 | Example |
| C16 | | | | OX-SQ | 5H | 7.6 | 88 | Example |
| D16 | | | | AC-SQ | 7H | 7.9 | 106 | |
| A17 | P17 | 120 | 1.22 | XC96-B0446 | 2H | 6.3 | 28 | Comparative |
| B17 | | | | OX-SQ/20SI | 4H | 6.2 | 45 | Example |
| C17 | | | | OX-SQ | 5H | 6.2 | 83 | Example |
| D17 | | | | AC-SQ | 7H | 6.3 | 99 | |

Referring to Table VI, the eddy current loss $We_{10/1k}$ is decreased and the three-point bending strength $\sigma_{3b}$ is improved in samples C14 to C17 and D14 to D17 in which an insulating coating film having a pencil hardness of 5H or higher after thermosetting is formed. These results show that irrespective of the material or the average particle diameter of the metal magnetic particles, the eddy current loss can be decreased and a compact with a high strength can be obtained when the maximum diameter/circle-equivalent diameter ratio $R_{m/c}$ is more than 1.15 and not more than 1.35 and when the pencil hardness of the insulating coating film after thermosetting is 5H or higher.

Figure 15:
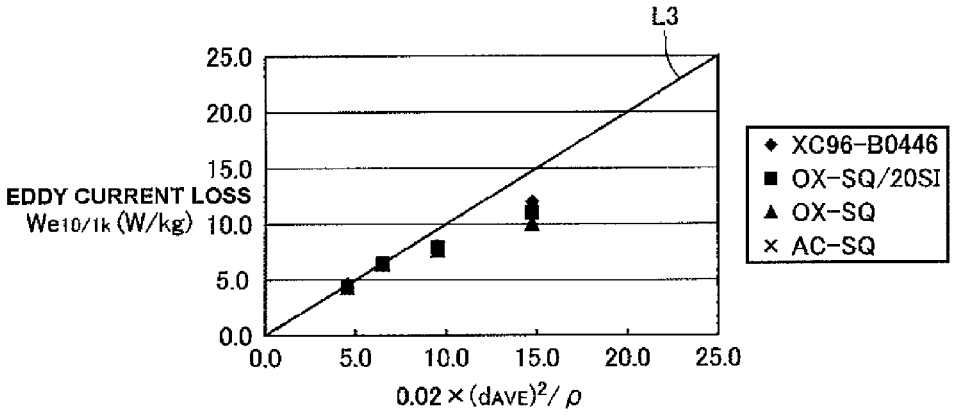
FIG. 15 is a graph showing the relationship between the eddy current loss $We_{10/1k}$ and the value of $0.02\times(d_{AVE})^2/\rho$ in Example 3 of the present invention.
Figure 16:
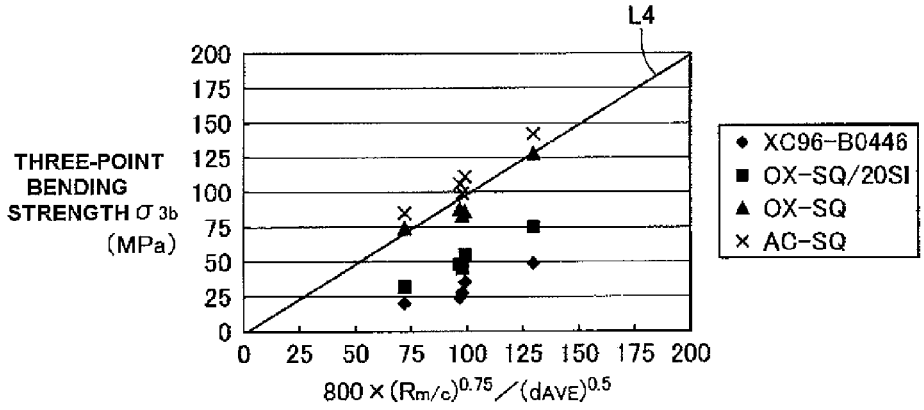
FIG. 16 is a graph showing the relationship between the three-point bending strength $\sigma_{3b}$ and the value of $800\times(R_{m/c})^{0.75}/(d_{AVE})^{0.5}$ in Example 3 of the present invention.

FIG. 15 is a graph showing the relationship between the eddy current loss $We_{10/1k}$ and the value of $0.02\times(d_{AVE})^2/\rho$. FIG. 16 is a graph showing the relationship between the three-point bending strength $\sigma_{3b}$ and the value of $800\times(R_{m/c})^{0.75}/(d_{AVE})^{0.5}$. In FIG. 15, line L3 is a straight line satisfying $We_{10/1k}=0.02\times(d_{AVE})^2/\rho$ (W/kg), and the eddy current loss $We_{10/1k}$ of samples C14 to C17 and D14 to D17, which are examples of the present invention, does not exceed $We_{10/1k}$ indicated by line L3. In FIG. 16, line L4 is a straight line satisfying $\sigma_{3b}=800\times(R_{m/c})^{0.75}/(d_{AVE})^{0.5}$ (MPa), and the three-point bending strength $\sigma_{3b}$ of samples C14 to C17 and D14 to D17, which are examples of the present invention, is not lower than $\sigma_{3b}$ indicated by line L4.

It should be understood that the embodiments and examples disclosed herein are mere examples and should not be considered to be limiting the scope of the invention. The scope of the present invention is defined not by the description above but by the claims attached hereto, which includes all modifications and alterations within the scope of the claims and their equivalents.

INDUSTRIAL APPLICABILITY

The present invention is used in, for example, motor cores, solenoid valves, reactors, and general electromagnetic components.

The invention claimed is:

1. A soft magnetic material comprising:

a plurality of composite magnetic particles each including a metal magnetic particle and an insulating coating film covering the metal magnetic particle, wherein each of the plurality of composite magnetic particles has a ratio $R_{m/c}$ of a maximum diameter to a circle-equivalent diameter of more than 1.15 and not more than 1.35, wherein the insulating coating film is composed of a thermosetting organic material and has a pencil hardness of 5H or higher after thermosetting, and wherein the metal magnetic particle contains Fe as the main component.

2. The soft magnetic material according to claim 1, wherein an average thickness of the insulating coating film in an uncured state is 10 nm or more and 500 nm or less.

3. The soft magnetic material according to claim 1, wherein an average particle diameter $d_{AVE}$ of each of the plurality of composite magnetic particles is 10 μm or more and 500 μm or less.

4. The soft magnetic material according to claim 1, wherein each of the plurality of composite magnetic particles further includes a coupling coating film between the metal magnetic particle and the insulating coating film.

5. A dust core produced by performing at least one of pressure forming, thermosetting, and heating the soft magnetic material of claim 1 to form the dust core.

6. The dust core according to claim 5, wherein when an average particle diameter of each of the plurality of composite magnetic particles is represented by $d_{AVE}$ (μ·m) and an electrical resistance of the metal magnetic particle is represented by ρ (μΩcm), an eddy current loss $We_{10/1\kappa}$ at an exciting magnetic flux density of 1 (T) and an exciting magnetic flux frequency of 1 (kHz) is $0.02\times(d_{AvE})^2/\rho$ (W/kg) or less and a three-point bending strength $\sigma_{3b}$ at room temperature is $800\times(R_{m/c})^{0.75}/(d_{AVE})^{0.5}$ (MPa) or more.

* * * * *